US007834683B2

(12) United States Patent
Truong et al.

(10) Patent No.: US 7,834,683 B2
(45) Date of Patent: Nov. 16, 2010

(54) METHOD TO REDUCE VARIATION IN CMOS DELAY

(75) Inventors: Phat Truong, Houston, TX (US); Jon Nguyen, Richmond, VA (US)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 228 days.

(21) Appl. No.: 12/129,683

(22) Filed: May 30, 2008

(65) Prior Publication Data

US 2009/0295466 A1 Dec. 3, 2009

(51) Int. Cl.
*G05F 1/10* (2006.01)

(52) U.S. Cl. ..... 327/541; 327/543

(58) Field of Classification Search ..... 327/541, 327/543

See application file for complete search history.

(56) References Cited

U.S. PATENT DOCUMENTS 4,477,737 A * 10/1984 Ulmer et al. ..... 327/541
4,833,350 A * 5/1989 Frisch ..... 326/64
6,288,600 B1 * 9/2001 Kadowaki et al. ..... 327/535
6,496,056 B1 * 12/2002 Shoji ..... 327/543
6,777,920 B2 * 8/2004 Furutani et al. ..... 323/280
7,279,960 B1 10/2007 Lee
7,282,972 B2 10/2007 Lin

* cited by examiner

*Primary Examiner*—Lincoln Donovan
*Assistant Examiner*—Ryan C Jager
(74) *Attorney, Agent, or Firm*—Winston Hsu; Scott Margo

(57) ABSTRACT

Controlled voltage circuit for compensating the performance variations in integrate circuits caused by voltage supply, temperature, and process variations is proposed. The controlled voltage circuit includes several MOSFET transistors connected in series, a unity gain operational amplifier, and a constant current source with an input terminal and an output terminal. The input source terminal of the first MOSFET is connected to a constant current source and to the unity gain operational amplifier. The output terminal of the circuit is connected to the CMOS delay block. To compensate for the performance variation, the output voltage node at or before the unity gain operational amplifier is shifted higher as the operating process state is slowed down or as the temperature is increased. Conversely, the output voltage node is shifted lower as the process becomes faster or the temperature is reduced.

8 Claims, 5 Drawing Sheets

METHOD TO REDUCE VARIATION IN CMOS DELAY

BACKGROUND OF THE INVENTION

1. Field of the Invention

The present invention relates generally to integrated circuits and, more particularly, to a method and circuit for reducing delay variations in CMOS circuits.

2. Description of the Prior Art

In many integrated circuits, the performance of a CMOS device varies with the voltage supply, temperature and process conditions or states. The speed of the circuit is generally faster as the supply voltage is increased. On the other hand, the circuit speed is generally slower as the supply voltage is decreased. As the supply voltage is increased, the temperature is reduced, and the operating process state is at a faster setting, the CMOS device tends to have an improved performance or a lesser propagation delay. On the other hand, with the increase in temperature, reduction in the supply voltage, and in the shifting of the operating process state to slower setting, the threshold voltage of the CMOS device is thereby increased; therefore, a negative impact on the performance of the corresponding integrate circuit, and more particularly, in designing a delay lock loop coarse delay step is resulted.

FIG. 1 is a block diagram illustrating a conventional constant voltage supply for reducing delay variations with the supply voltage. In this conventional design, the supply voltage to the CMOS delay is to remain constant. However, the CMOS delay remains having to vary in accordance with temperature and process variations.

The problem of delay variations in DLL design is well-known in the art, and there are a number of commonly-used solutions for combating it. One solution is to provide a common mode amplifier circuit, which uses pull up resistor and tail current to control the variations in temperature, process and supply. Another scheme is to generate local supply for each delay step unit. Many of the commonly-known methods for overcoming delay variation in DLL design, however, have significant drawbacks such as increased die area and power consumption.

SUMMARY OF THE INVENTION

In accordance with one aspect of the invention, a controlled voltage circuit for compensating the performance variation and reducing the gap variation in CMOS propagation delay due to variations in supply voltage, temperature and process is provided and described.

In one embodiment of the present invention, the circuit for reducing variations in CMOS delay includes one constant current source, one unity gain operational amplifier and a plurality of transistors. The transistors are connected in series. In addition, the circuit is comprised of an input terminal and an output terminal. The transistors can be in the form of a P-channel MOSFET and a N-channel MOSFET. The source terminal input of the P-channel MOSFET transistor and the gate terminal of a N-channel MOSFET transistor, disposed adjacent to the P-channel MOSFET transistor, is connected to the constant current source. In addition, the source terminal input of the P-channel MOSFET transistor is also an input to a positive input side of a unity gain operational amplifier. The constant current source can be generated by a generator or a current mirror source. A gate terminal of the P-channel MOSFET transistor is connected to the source/drain joint terminal of the N-channel MOSFET in series. Another P-channel MOSFET transistor (second P-channel MOSFET) has a gate sink to ground. Moreover, on the N-channel MOSFET transistor input, a first N-channel MOSFET transistor has a gate connected to the source/drain terminal of a first P-channel MOSFET transistor, a second input terminal of a second N-channel MOSFET is connected to the output terminal. In this embodiment, the input terminal of the unity gain operational amplifier is to provide the adjustable voltage level for each set of actual processing conditions based upon the voltage supply, operating temperature, and operating process state.

In another embodiment of the present invention, a plurality of transistors includes a first transistor and a second transistor, which are connected in series. The first transistor is a P-channel MOSFET transistor and the second transistor is a N-channel MOSFET. In this embodiment, the source terminal of the first transistor is connected to both the constant current source and the positive input node of the unity gain operational amplifier. Meanwhile, the gate terminal of the first transistor is connected to the source-drain terminal of the second transistor. The source terminal of the second transistor is connected to the drain terminal of the first transistor. In addition, the gate terminal of the second transistor is source to ground; and the source terminal of the second transistor is connected to the ground voltage source.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
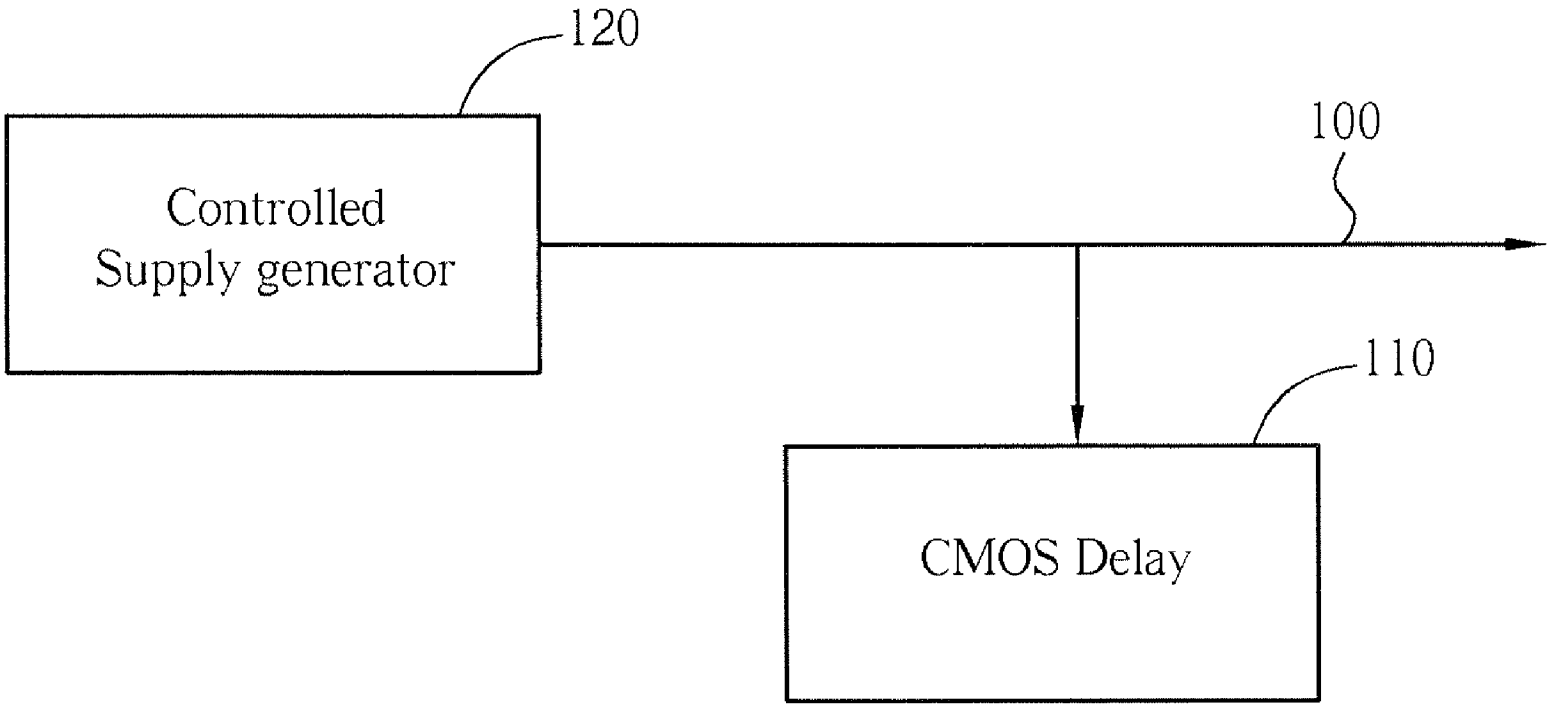
FIG. 2 is a block diagram illustrating the use of the controlled voltage supply to compensate for the CMOS delay according to an embodiment of the present invention.

FIG. 2 illustrates a conceptual block diagram for a controlled supply 100 to compensate for the CMOS delay 110 according to an embodiment of the present invention. A controlled supply generator 120 is seen to exemplify the corresponding circuit as described in the embodiments below.

Figure 3:
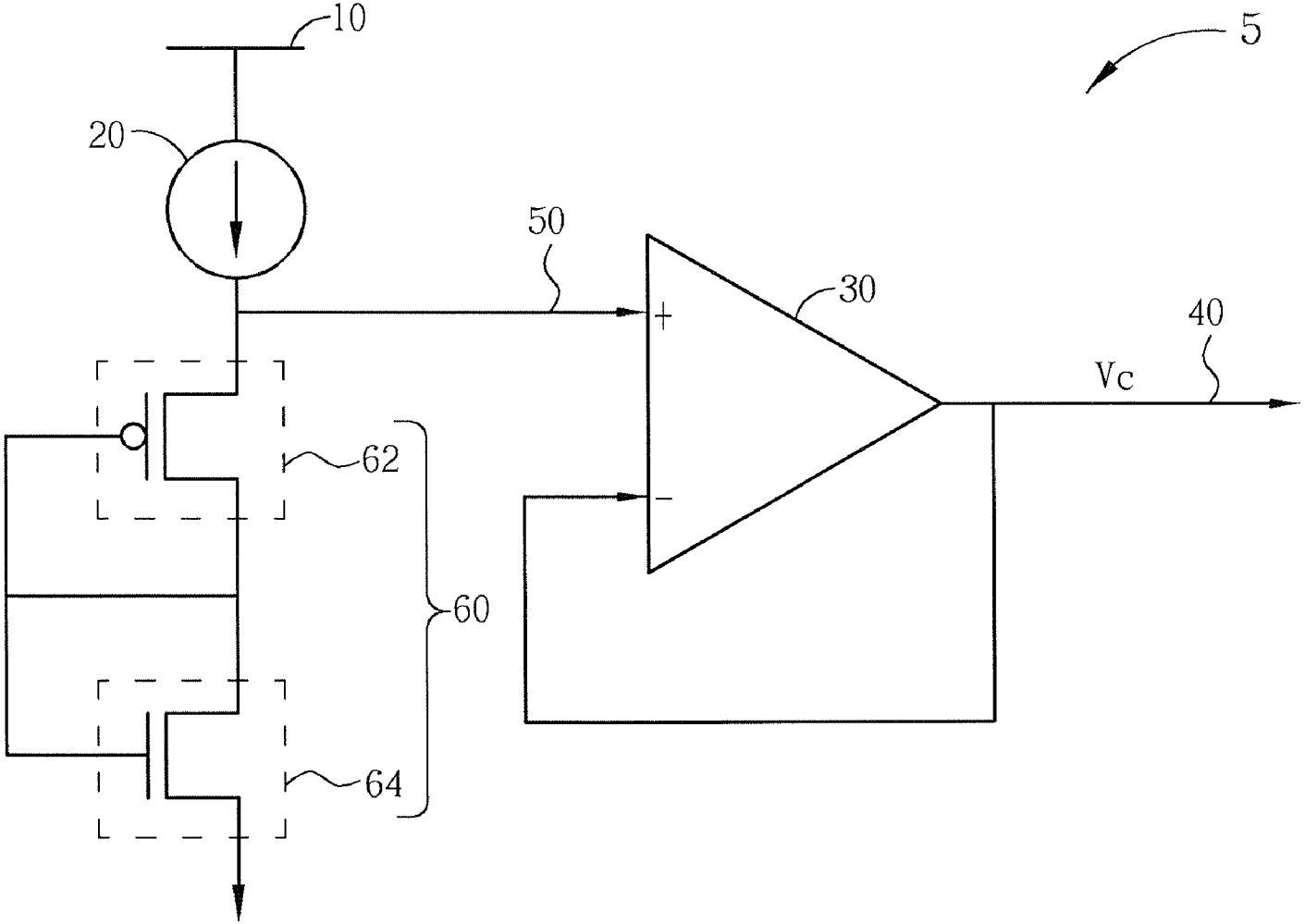
FIG. 3 is a controlled voltage circuit for reducing CMOS delay according to a first embodiment of the present invention.

FIG. 3 illustrates a controlled voltage circuit 5 for reducing CMOS delay in accordance with a first embodiment of the present invention. The circuit 5 in the first embodiment includes a voltage supply 10, a constant current source 20, a unity gain operational amplifier 30, a controlled supply 40, a controlled voltage signal line 50, and a plurality of transistors 60. The controlled supply 40 includes a controlled voltage $V_c$ for controlling voltage variations at the controlled supply 40. The voltage supply 10 and the controlled supply 40 can be in the form of analog circuits.

According to the first embodiment, the transistors include a first transistor 62 and a second transistor 64, which are connected in series. The first transistor 62 is a P-channel MOSFET, in which the source terminal is connected to both the constant current source and the positive input node of the unity gain operational amplifier 30. Meanwhile, the gate terminal of the first transistor 62 is connected to the drain terminal of the second transistor 64, which is a N-channel MOS- FET. In addition, the drain terminal of the second transistor 64 is connected to the drain terminal of the first transistor 62. The gate terminal of the second transistor 64 is connected to the gate terminal of the first transistor 62; and the source terminal of the second transistor 64 is connected to the ground voltage source.

The input terminal of the circuit 5 is at the constant current source 20; and the output terminal of the circuit 5 is at the controlled supply 40. The voltage of the controlled voltage signal line 50 can be adjusted to compensate for losses due to supply voltage, temperature and process variations. Furthermore, the output of the unity gain operational amplifier 30 is to provide a more consistent delay for the circuit 5.

Referring to Table 1 below, the delays, as measured in picoseconds and based on simulations of DLL using CMOS NAND as unity delay, are more consistent and uniform at different sets of operating temperatures and operating process conditions, according to the first embodiment. In other words, the delays for all three cases, namely a "fast case", a "normal case", a "slow case", are more consistent for the present embodiment than the corresponding delays as obtained using conventional method (see FIG. 1). In addition, as shown in Table 1, the delays at −10° C., 85° C., and 110° C. are also more consistent than the corresponding delays as obtained using the conventional method under all three operating process states, namely "fast case", "normal case", and "slow case".

TABLE 1

Delays versus Operating Temperatures and Operating Process States

| Operating Process State | | Temperature, −10° C. | Temperature, 85° C. | Temperature, 110° C. |
|---|---|---|---|---|
| "Fast Case" | Conventional | 126 ps | 135 ps | 137 ps |
| "Fast Case" | 1st Embodiment | 148 ps | 146 ps | 146 ps |
| "Normal Case" | Conventional | 154 ps | 164 ps | 166 ps |
| "Normal Case" | 1st Embodiment | 159 ps | 159 ps | 158 ps |
| "Slow Case" | Conventional | 187 ps | 199 ps | 201 ps |
| "Slow Case" | 1st Embodiment | 169 ps | 169 ps | 171 ps |

Figure 1:
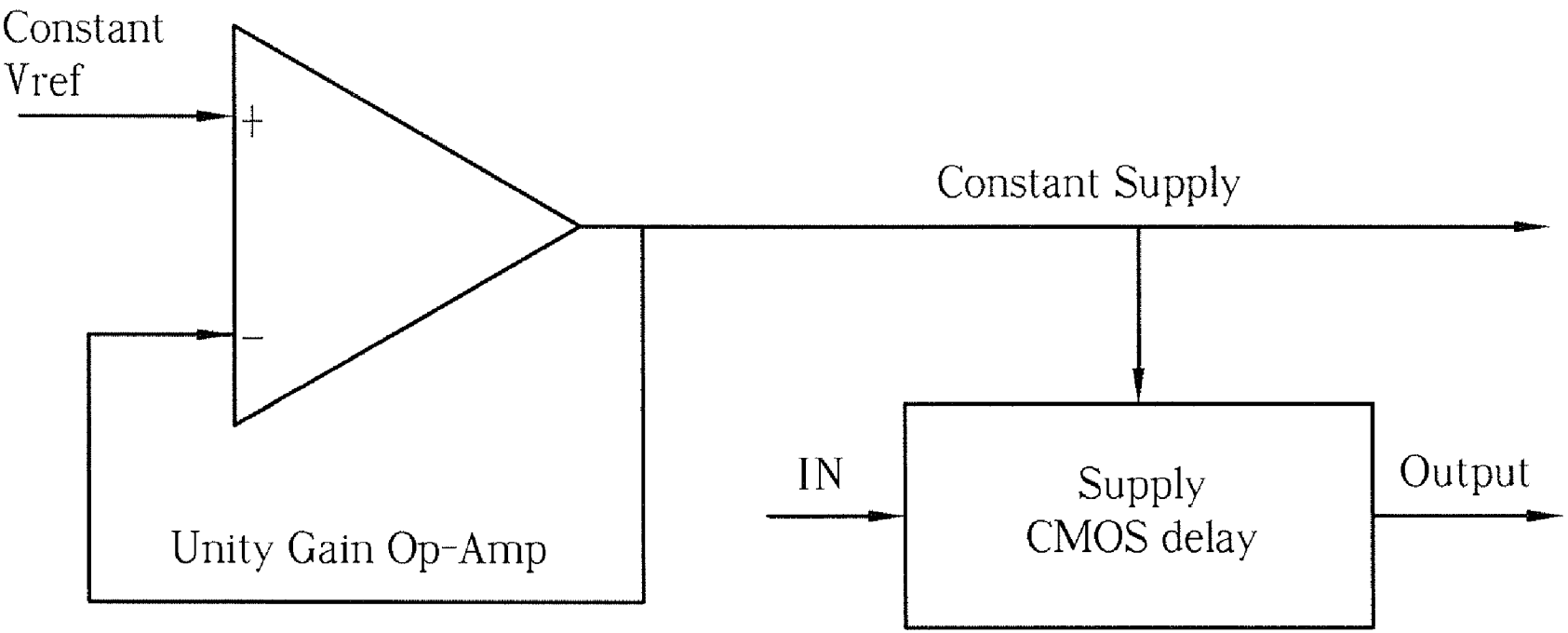
FIG. 1 PRIOR ART
FIG. 1 is a block diagram illustrating a conventional constant voltage supply for reducing delay variations with the supply voltage.

For quantifying and comparing the consistency of the above delays with respect to that of the conventional method, for example, as shown in FIG. 1, the standard deviations of all three delays are calculated across operating temperatures at −10° C., 85° C., and 110° C., and are presented below in Table 2:

TABLE 2

Delay Variability for Conventional versus First Embodiment

| Operating Process State | | Standard Deviation, +/− |
|---|---|---|
| "Fast Case" | Conventional | 5.86 |
| | 1st Embodiment | 1.15 |
| "Normal Case" | Conventional | 6.43 |
| | 1st Embodiment | 0.58 |
| "Slow Case" | Conventional | 7.57 |
| | 1st Embodiment | 1.15 |

Based upon the simulation results as presented in Tables 1-2 above, further deductions or analyses clearly indicate that the variability of the delay for the first embodiment of the present invention is much less than that of the conventional method shown in FIG. 1 under various combinations of operating process states and operating temperatures.

In reference to the three different operating process states described in the above embodiment and in Tables 1-2, a "fast case" is defined to be at +2 sigma; a "normal case" is defined to be at the standard operating state; and a "slow case" is defined to be −2 sigma.

Figure 4:
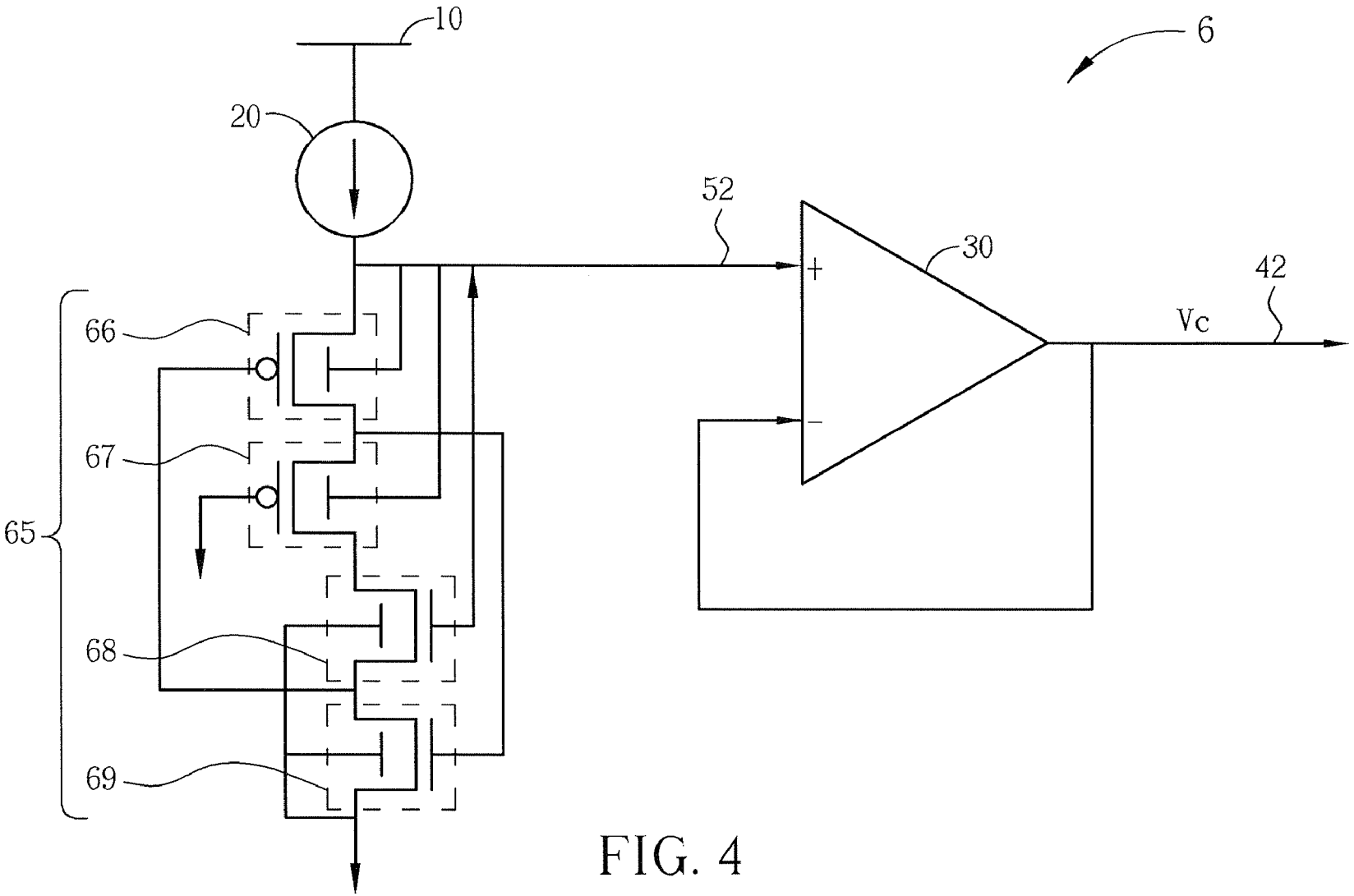
FIG. 4 is another controlled voltage circuit for reducing CMOS delay according to a second embodiment of the present invention.

FIG. 4 illustrates another controlled voltage circuit 6 for reducing CMOS delay in accordance with a second embodiment of the present invention. The circuit 6 as shown in FIG. 4 includes the voltage supply 10, a controlled supply 42, the constant current source 20, the unity gain operational amplifier 30, a controlled voltage signal line 52, and a plurality of transistors 65. The controlled supply 42 includes a controlled voltage $V_c$ for controlling voltage variations at the controlled supply 42. The voltage supply 10 and the controlled supply 42 can be in the form of analog circuits.

According to the second embodiment of the present invention, the transistors 65 include a first transistor 66, a second transistor 67, a third transistor 68, and a fourth transistor 69, which are all connected in series. The first transistor 66 is a P-channel MOSFET; the source terminal of the first transistor 66 is connected to both the constant current source 20 and the positive input node of the unity gain operational amplifier 30. Furthermore, the gate terminal of the first transistor 66 is connected to the source/drain joint terminal of the third transistor 68 and the fourth transistor 69 in series. In addition, the source terminal of the second transistor 67 is connected to the drain terminal of the first transistor 66; and the gate terminal of the second transistor 67 is source to ground. The third transistor 68 is an N-channel MOSFET and it includes a gate terminal connected to the positive side input of the unity gain operational amplifier 30. Meanwhile, a drain terminal of the third transistor 68 is connected to the drain of the second transistor 67. The fourth transistor 69 is an N-channel MOSFET, and it includes a gate terminal connected to both the drain of the first transistor 66 and to the source of the second transistor 67. In addition, the source terminal of the fourth transistor 69 is coupled to ground.

Referring to FIG. 4, the input terminal of the circuit 6 is at the constant current source 20; and the output terminal of the circuit 6 is at the controlled supply 42. A notable feature of the present embodiment is the adjusting of the voltage of the controlled voltage signal line 52 for compensating various losses due to variations in supply voltage, temperature and process. Additionally, the output of the unity gain operational amplifier 30 is able to provide a more consistent and uniform delay, which is not affected as much by variations in supply voltage, temperature and process.

Figure 5:
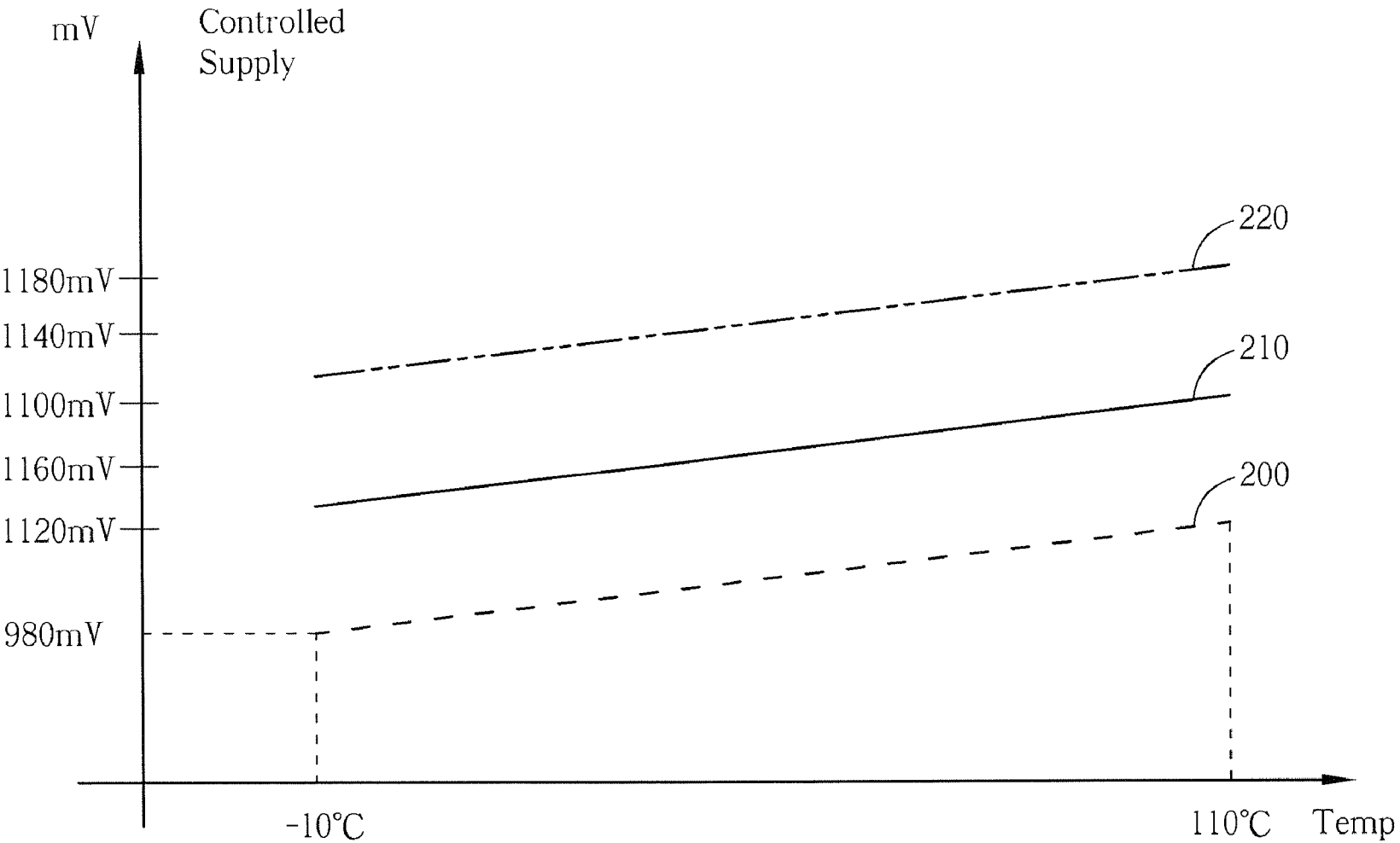
FIG. 5 is a plot diagram illustrating the relationship of the voltage for the control supply with respect to the temperature and process conditions via simulation.

Referring to FIGS. 4-5, a method according to another embodiment of the present invention for adjusting the voltage of the controlled voltage signal line proportional to the operating temperature or with respect to the operating process state after determining the operating temperature or the operating process state of the circuit 6 is proposed. In addition, referring to FIG. 5, The corresponding data for three operating process states, namely a "fast case" 200, a "normal case" 210, and a "slow case" 220 are presented.

In this method, an input terminal is formed at the constant current source 20 and an output terminal is formed at the controlled supply 42. Furthermore, using the circuit 6 from the second embodiment and making adjustments to voltage of the controlled voltage signal line 52 using the data presented in FIG. 5, reduction in CMOS delay variations due to supply voltage, temperature and process variations can be achieved, thereby providing a more consistent delay for the circuit 6.

Those skilled in the art will readily observe that numerous modifications and alterations of the device and method may be made while retaining the teachings of the invention.

What is claimed is:

1. A controlled voltage circuit for reducing variations in CMOS delay, the controlled voltage circuit comprising:

a voltage supply;

a controlled supply comprising a controlled voltage for controlling voltage variations at the controlled supply;

a constant current source, having a first terminal connected to the voltage supply;

a unity gain operational amplifier, having a positive input node connected to a second terminal of the constant current source, a negative input node connected to an output of the unity gain operational amplifier, and the output of the unity gain operational amplifier connected to the controlled supply;

a controlled voltage signal line, connected between the second terminal of the constant current source and the positive input node of the unity gain operational amplifier; and a plurality of transistors, comprising of a first transistor, a second transistor, a third transistor, and a fourth transistor connected in series; wherein an input terminal of the controlled voltage circuit is at the constant current source, and an output terminal of the controlled voltage circuit is at the controlled supply; the voltage of the controlled voltage signal line is adjusted for compensating losses due to supply voltage, temperature and process variations; and the output of the unity gain operational amplifier is to control the controlled voltage circuit;

wherein the first transistor is a P-channel MOSFET; a source terminal of the first transistor is connected to the second terminal of the constant current source and the positive input node of the unity gain operational amplifier; a gate terminal of the first transistor is connected to a source/drain joint terminal of the third transistor and the fourth transistor connected in series.

2. The controlled voltage circuit of claim 1, wherein the second transistor is a P-channel MOSFET; a source terminal of the second transistor is connected to a drain terminal of the first transistor; and a gate terminal of the second transistor is source to ground.

3. The controlled voltage circuit of claim 2, wherein the third transistor is an N-channel MOSFET; a gate terminal of the third transistor is connected to the positive side input of the unity gain operational amplifier; and a drain terminal of the third transistor is connected to a drain of the second transistor.

4. The controlled voltage circuit of claim 3, wherein the fourth transistor is an N-channel MOSFET; a gate terminal of the fourth transistor is connected to both the drain of the first transistor and to the source of the second transistor; a drain terminal of the fourth transistor is connected to a source terminal of the third transistor; and a source terminal of the fourth transistor is connected to the ground.

5. The controlled voltage circuit of claim 4, wherein the voltage supply and the controlled supply are of a plurality of analog circuits.

6. The controlled voltage circuit of claim 1, wherein the third transistor is an N-channel MOSFET; a gate terminal of the third transistor is connected to the positive side input of the unity gain operational amplifier; and a drain terminal of the third transistor is connected to a drain of the second transistor.

7. The controlled voltage circuit of claim 1, wherein the fourth transistor is an N-channel MOSFET; a gate terminal of the fourth transistor is connected to both a drain of the first transistor and to a source of the second transistor; and a source terminal of the fourth transistor is connected to ground.

8. The controlled voltage circuit of claim 1, wherein the voltage supply and the controlled supply are of a plurality of analog circuits.

* * * * *